US006233410B1

(12) United States Patent
Seber et al.

(10) Patent No.: US 6,233,410 B1
(45) Date of Patent: May 15, 2001

(54) CONSUMABLE MATERIAL MANAGEMENT SYSTEM AND METHOD

(76) Inventors: Michael John Seber, 12 Glenfield Dr., Great Doddington, Northants NN29 7TE; Christopher John Morgan, 13a Aylesford Way, Stapleford, CAMBS. CB2 5DP; Geoffrey Fermor-Dunman, 6 The Orchards, Orton Waterville, Peterborough PE2 5LA, all of (GB)

( * ) Notice: Subject to any disclaimer, the term of this patent is extended or adjusted under 35 U.S.C. 154(b) by 0 days.

(21) Appl. No.: 09/077,867

(22) PCT Filed: Dec. 9, 1996

(86) PCT No.: PCT/GB96/03025

§ 371 Date: Mar. 3, 1999

§ 102(e) Date: Mar. 3, 1999

(87) PCT Pub. No.: WO97/21548

PCT Pub. Date: Jun. 19, 1997

(30) Foreign Application Priority Data

Dec. 8, 1995 (GB) ..... 9525167

(51) Int. Cl.[7] ..... G03G 15/00

(52) U.S. Cl. ..... 399/24; 399/12; 399/25

(58) Field of Search ..... 399/24, 25, 27, 399/12, 13; 101/114–118, 121–122, 124, 126, 127, 127.1, 128, 128.1

(56) References Cited

U.S. PATENT DOCUMENTS 5,835,817 * 11/1998 Bullock et al. ..... 399/25

FOREIGN PATENT DOCUMENTS

613785 * 9/1994 (EP) .
2257093 * 1/1993 (GB) .
59-16792 * 1/1984 (JP) .
2-122973 * 5/1990 (JP) .
7-261613 * 10/1995 (JP) .

* cited by examiner

*Primary Examiner*—Quana M. Grainger
(74) *Attorney, Agent, or Firm*—Flint & Kim, P.A.

(57) ABSTRACT

In a device 1 which uses consumable material, an electronic device 24 is attached to the packaging 20 of the consumable which stores information about the consumable, and the quantity remaining in the packaging. The device is thus capable of reading such information and updating it by decrementing a counter of the electronic device 24 and optionally responding accordingly, i.e. if the wrong type of consumable is used.

3 Claims, 7 Drawing Sheets

CONSUMABLE MATERIAL MANAGEMENT SYSTEM AND METHOD

This invention relates to the application of electronic data storage means to packaging for a consumable material. In particular it provides a method and apparatus for processing a consumable material, a packaging for consumable material for use therein, and a kit of parts for apparatus to convert it to embody this invention.

Many devices utilise materials which are consumable and must be replaced when the supply runs out. In many instances, the quality, type, colour, size etc of the material must not be changed inadvertently, in that in some cases the type of consumable can be changed if the device is adapted accordingly. If this specification of the material is allowed to change such as by using the wrong type of material, the device which is utilising it may be damaged or the end product produced by the device may be defective. The onus is therefore on the user to ensure that the new material meets the appropriate specification. A further problem is the availability of inferior quality substitutes for consumable material. Such material may be represented as a suitable replacement for a particular consumable, but may be of an inferior quality to that specified by the manufacturer of the device on which it is to be used.

A further problem with the supply of consumable material is that the packaging, in which the material is supplied, often hides the quantity of material which remains. Also, when the material has been inserted into the device in which it is to be used it may be difficult to gain access to monitor the amount of material remaining. Therefore, the user may be unaware that the material is running low until the device begins to malfunction because the consumable material is exhausted.

Various prior attempts have been made to monitor the matching of consumables with a machine on which they are to be used. For example, GB-A-2216437 discloses a toner cartridge having means for indicating the type of toner stored therein, and this can be used to prevent the mixing, with the residual toner already in the consuming machine, of a different kind of toner from a fresh cassette. The monitoring is effected by various possible means such as reflecting pads, a magnetic material, or an electrical resistance, indicative of the type of toner in the packaging. GB-A-2257093 discloses a laser printer on which the toner cartridge has a memory which can be read by the printer, so that unless the appropriate cartridge is inserted in the cartridge-receiving slot the laser cannot be activated. This prevents the possibility of an engineer, carrying out maintenance work, being damaged by exposure to the laser emission when either no cartridge is present in the toner cartridge slot or the presence of an incorrect cartridge in the slot may allow leakage of the laser emission to the exterior.

It is also known to monitor the presence of consumables, for example in EP-A-0653307 where a sensor monitors if a sheet of paper has been supplied and will stop a printer if no sheet is detected, and in U.S. Pat. No 4,141,646 where a light emitter and detector are present to sense the concentration of developing liquid in the storage reservoir. However, these systems monitoring the consumable are simply there to detect current operating parameters regarding consumables rather than indicating the expected further useful life of the consumable supply.

It is an aim of the present invention to overcome these problems by providing a means of packaging consumable material to provide information about the status of the material in the packaging.

Therefore, according to one aspect of the present invention there is provided a processing apparatus including a package for a consumable material which is utilised therein, the apparatus comprising:

utilisation means for using said consumable material;

control means for controlling operation of said apparatus; and holder means for the package containing said consumable material, characterised in that said holder means is provided with electrical contacts connected to said control means;

said holder contacts are connectable to corresponding contacts on said package;

said package contacts are connected to an electronic memory means in said package for providing data indicative of the status of the consumable material; wherein said control means is operative to interrupt normal operation of said utilisation means in the absence of expected status data, and said electronic memory means includes a decrement only counter to be decremented by the control means as the utilisation means uses the consumable. For example, in the case of a stencil duplicator, where the consumable material is stencil master, the master feed means may be interrupted or the mode of operation (i.e. photo quality or text quality which differ in that photo-quality includes pixel dropping giving reduced image quality) may be restricted to one particular mode.

The status data may be the quantity remaining and may be updated by the control system as the consumable material is used to provide a record in the electronic means of the amount of consumable remaining in the packaging. The apparatus therefore preferably comprises monitoring means for providing information about the amount of material being used to allow the control system to update the status data provided by said electronic means in the packaging.

In the event that the apparatus is operating but the monitoring means does not detect the usage of consumable material, then the control means will preferably interrupt normal operation of the apparatus. For example, again referring to a stencil duplicator, it may be possible for the user to deliberately disable the monitoring means in an attempt to overcome the features of the system. Thus if the system expects ink to be used, and thus expects the pump to pump, and such pumping is not detected within a certain number of copies for example, the pump can be disabled.

The present invention is particularly suited for use in copying and printing devices such as stencil duplicators where both ink and stencil master material are used-up during the printing process. In this case, the utilisation means may include (i) ink; pumping means for pumping the ink from the packaging means, or (ii) a stencil master feed means controlling the supply of stencil masters. In this way, the control means can interrupt normal operation of the duplicator by inhibiting the ink pumping means or the stencil master feed means. Where the duplicator is provided with means for selecting one of a plurality of different printing modes of which one is a photo mode, it may be advantageous to restrict the user's choice of such printing modes e.g. to the photo mode printing only.

A second aspect of the invention provides the kit of parts defined in claim 13.

Yet a further aspect of the invention provides the kit of parts defined in claim 14.

A fourth aspect of the invention provides a method as defined in claim 15.

In order that the present invention may more readily be understood, the following description is given, by way of example, with reference to the accompanying drawings, in which:

FIG. 1 is a partially cut away view of a stencil duplicator according to the present embodiment;

FIGS. 2*a* to 2*d* show an ink supply box for use with the apparatus according to the present invention;

Figure 1:
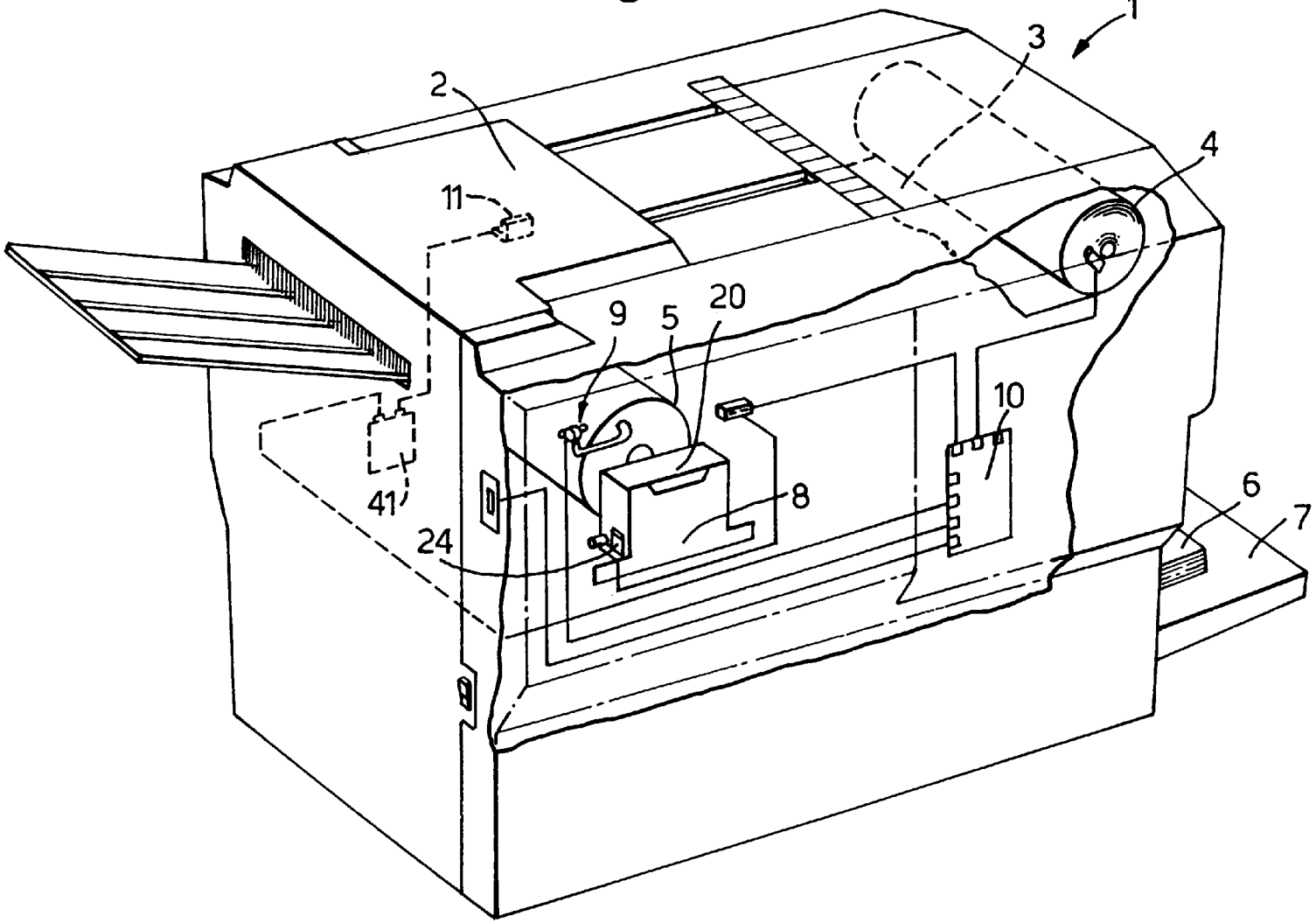
Figure 2A:
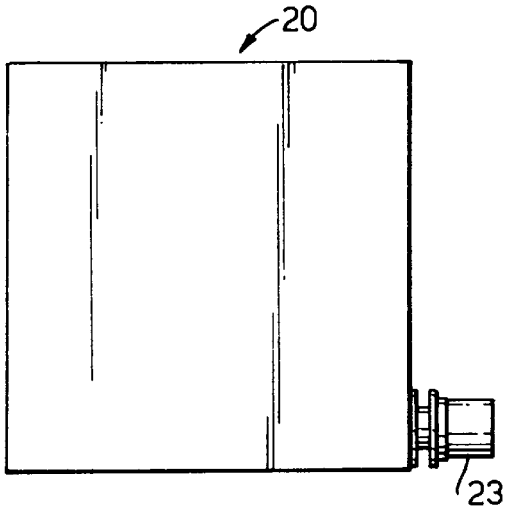
Figure 2B:
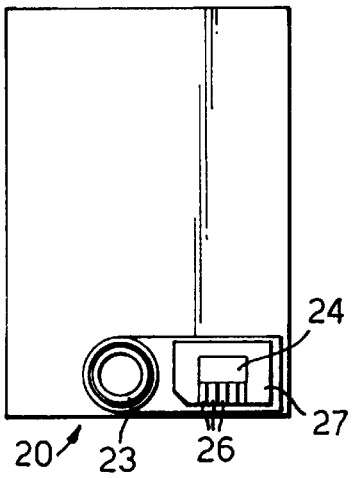
Figure 2C:
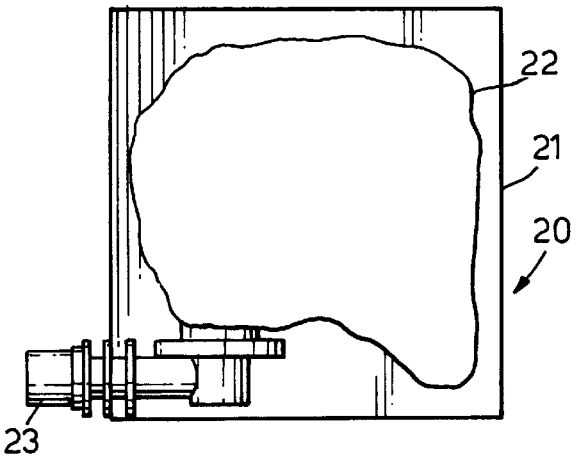
Figure 2D:
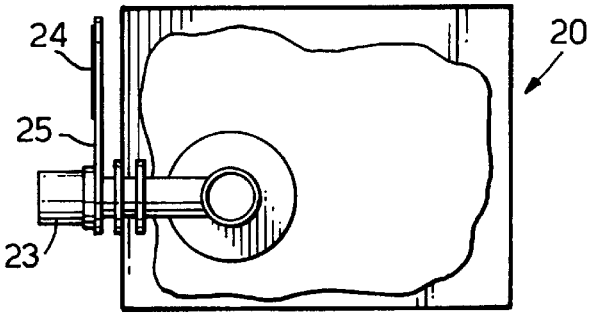

FIG. 1 shows a "copy printer" comprising a stencil duplicator 1 according to an embodiment of the present invention. An original to be copied is fed through a scanning device 2 on the top of the duplicator. A stencil master is produced by the unwinding of an appropriate section of master material 3 from a master reel 4, past a cutting head for producing holes in the polyester film layer of the stencil master corresponding to the image on the original. The advancing stencil master is then rolled around a printing drum 5 in readiness for printing. Once printing begins, paper 6 is fed from a paper feed tray 7 into the machine and then passed by the printing drum 5. Ink for the printing process is provided in a "wine box" type packaging 20 (see FIG. 2). The ink supply packaging 20 includes a housing 21, a bag 22 for housing the ink, and a nozzle arrangement 23 for extracting the ink.

Referring again to FIG. 1, an ink pump pumps the ink from the ink supply 20, to the drum 5 which has a porous outer surface. The ink is driven through the porous outer surface of the drum and through the holes cut in the stencil to form an image on the paper 6 pressed against the rotating drum surface.

When the ink supply is exhausted, the entire ink container 20 is removed from the printer and replaced with a similar ink package. In order to avoid variations in the quality of the printing produced, or indeed damaging the duplicator itself, it is important to ensure that the replacement ink is of a similar kind to that which it is replacing. For example if a different coloured ink was accidentally inserted, it may take several hundred copies before the old ink is flushed through the system consequently wasting large amounts of ink and paper. Also if the wrong type of ink is used, then it may be necessary to replace the drum or have the drum cleaned, again, resulting in waste of ink and potentially the expense of having to replace or clean the drum.

With the kind of packaging used with the machine, it is difficult to ascertain how much ink remains inside the packaging. Therefore the user will only know that the ink has run out when the ink container is empty and either the detector shuts down the machine when the ink quantity in the drum fails to recover in response to an ink demand signal, or in a more simple machine the printing continues but print quality is seriously degraded. This can be particularly important when the duplicator is being used to print documents in different colours on a regular basis, requiring the ink container 20 and the drum 5 to be removed and exchanged between each colour printing, such that the user may come to start printing and only then discover that the ink container 20 is empty.

The stencil masters used in duplicators are only usable once and are therefore eventually used up by the machine. Again, it is difficult to judge accurately the amount of master remaining on a reel. It is only when the last master is removed that the user will know that the reel of master must be changed. Furthermore the reel of masters is contained within the body of the duplicator and is not visible unless the user opens the covers of the machine to check. It is also important to ensure that the correct type of master is used for a given application.

In order to overcome these problems the present invention utilises electronic devices similar to those currently used on "smart cards". These devices, referred to herein as "smart chips" (such as the Siemens SLE4406 and the Philips PCF 7960) can be used to store data on them relating to the package to which they are attached. In this case the various details regarding the specification of the ink or stencil master can be recorded, such as colour, type, quality, quantity, "use by" date, etc., to be read by the duplicator when the packaging (4,20) is inserted into the duplicator. Thus if the duplicator detects that the wrong coloured ink or wrong type of master material has been inserted, it can sound an audible alarm to warn the user. Further the device can also be used to provide a counter which can be decremented in use, to act as a "fuel gauge" indicating the amount of remaining ink in the ink packaging 20 or master 3 on the master roll 4.

For ease of use, it is desirable to provide these smart chips on the packaging such that when the packaging is inserted into the duplicator in the usual manner, the smart chip is simultaneously connected to the controller in the duplicator. This avoids the need for the user to separately connect the smart chip to the controller, simplifying their use and avoiding problems should the user forget to connect up the smart chip. The method of mounting the smart chip on the packaging will vary depending on the manner of the packaging itself.

Figure 6:
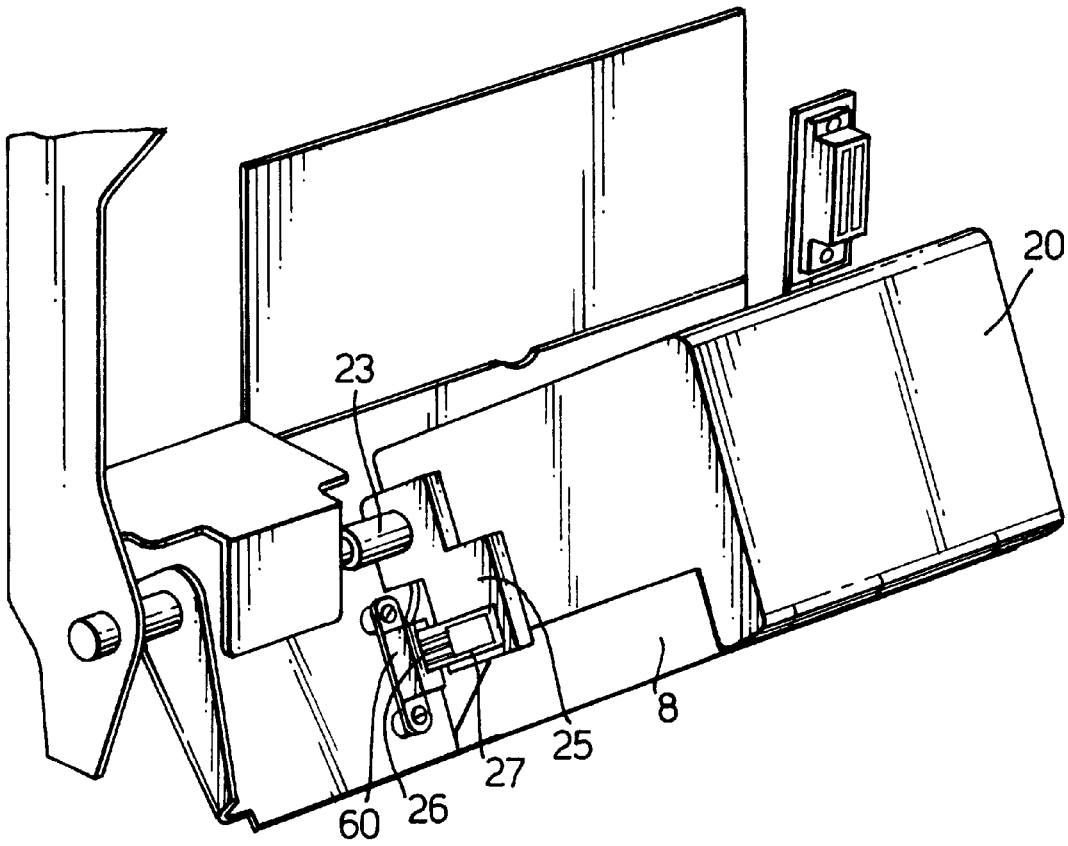
FIG. 6 shows a view of the ink box positioned in the holder which is in the loading position.

In the case of the ink packaging 20, one of the smart chips is mounted on a flange 25 (FIGS. 2A to 2D) which extends from the nozzle 23 of the ink container 20. The smart chip 24 is attached to a substrate such as a PCB 27 or the like which is provided with edge connectors 26 mounted on the edge of the flange for connecting to the duplicator when the ink container 20 is in position on the duplicator (see FIG. 6). The ink container 20 is held in a holder 8 in the duplicator which accurately locates the ink container in a fixed position by sliding leftwardly to connect the nozzle 23 to an ink pump inlet as the holder 8 is closed. As the ink container is inserted into the holder 8, the edge connectors 26 engage in a connector 60 provided in the holder 8 connecting the duplicator to the smart chip 24 device on the container. The duplicator can then read the appropriate data from the smart chip and also decrement the fuel gauge counter in the chip of the ink container as the ink is used.

Figure 5A:
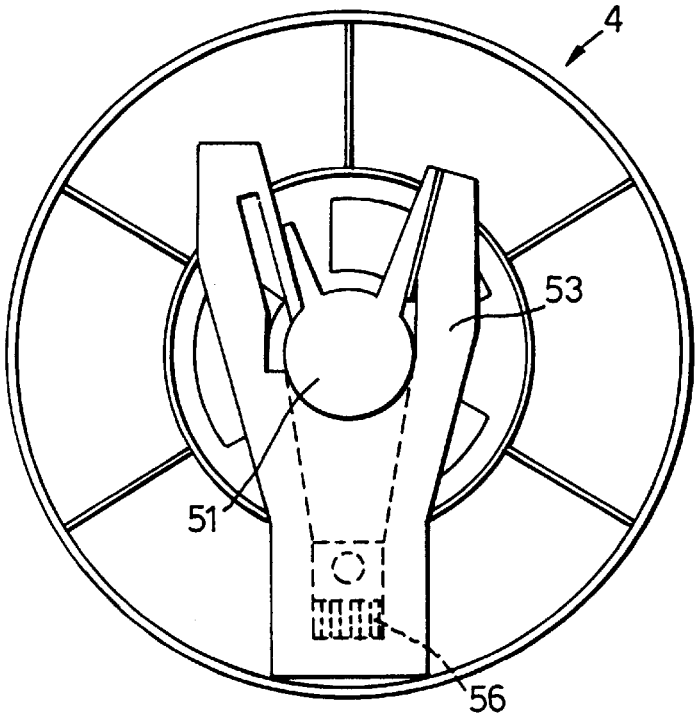
FIGS. 5A and 5B show a reel of master.
Figure 5B:
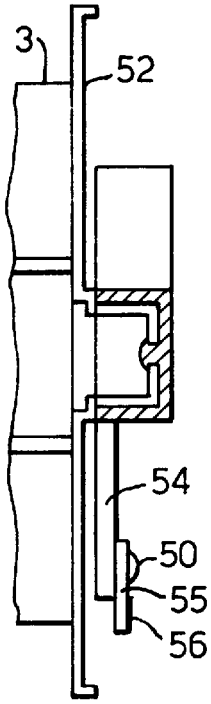
Figure 7:
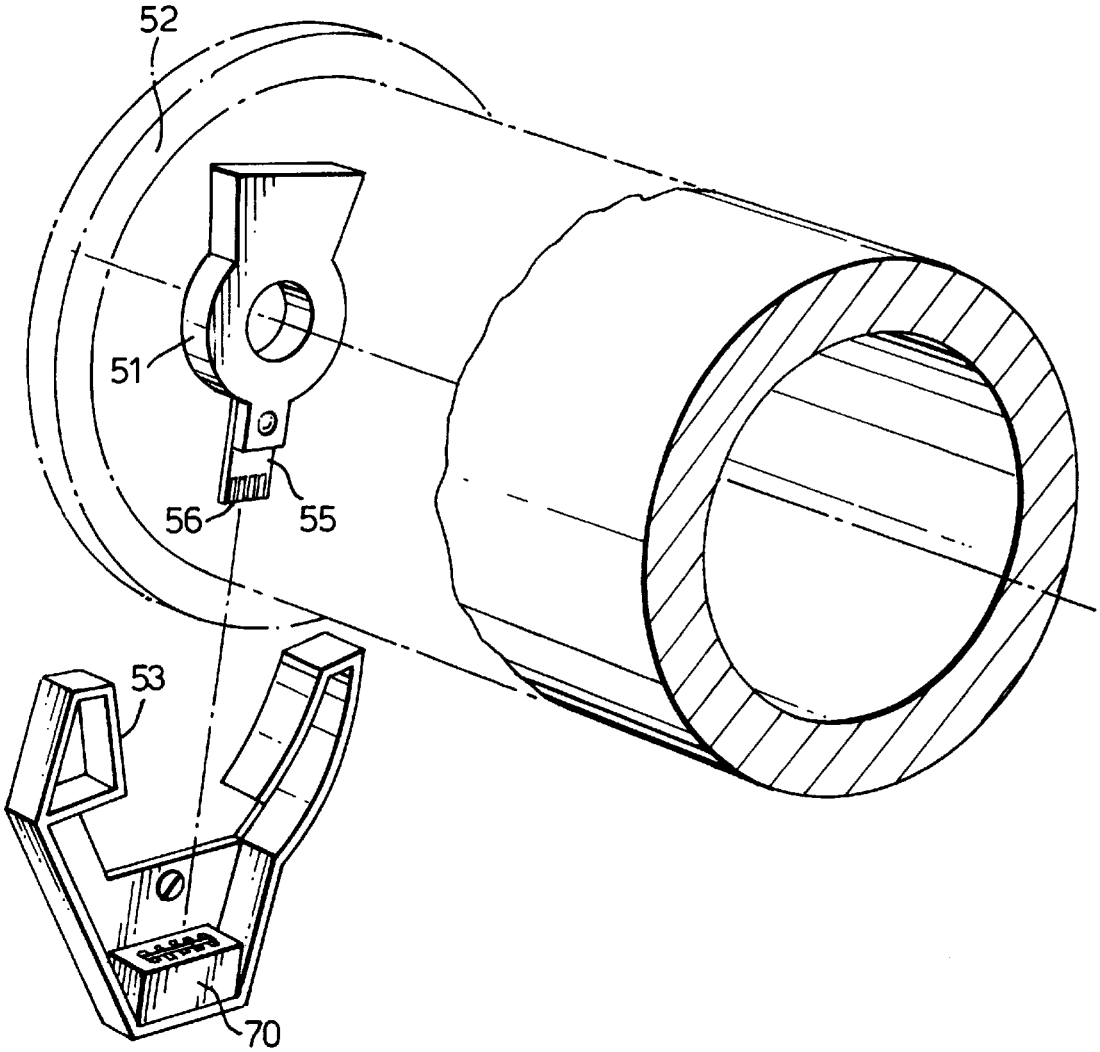
FIG. 7 shows the stencil master and the receiver for the connector to the electronic means.

As shown in FIGS. 5A, 5B and 7, the reel of master 4 is provided with substantially circular engaging lugs 51 on the end caps 52, on the end of each roll. Each of these lugs is pushed into a receiving portion 53 in the duplicator. One of the lugs 51 is provided with an extension 54, to the end of which is attached a smart chip 50, again mounted on a substrate such as a PCB 55. As the master reel 4 is inserted into the duplicator, the lugs 51 engage the receiving portions 53 and the PCB substrate is simultaneously guided into a socket 70 (see FIG. 7). The PCB is provided with edge connectors 56 which engage with corresponding connectors in the socket 70. The duplicator can then read the data from the smart chip 50 and correspondingly decrement the counter of the stencil roll chip as the stencil master is used up.

Clearly these methods of mounting the smart chips are not intended as the only construction. The primary requirements are that the smart chip remains firmly attached to the packaging and the packaging has the contacts connected to the smart chip, positioned and arranged, so that they positively engage the corresponding contacts on the duplicator (or other utilisation means). One alternative would be to form the nozzle such that the chip is retained in the wall and perhaps with contacts on the neck of the nozzle.

The duplicator is provided with an ink pump monitoring means 9 which gives an indication of the rate at which ink is being pumped out of the container and into the drum 5. This information is passed to a control board 10, in this case provided in the conventional duplicator.

Figure 3:
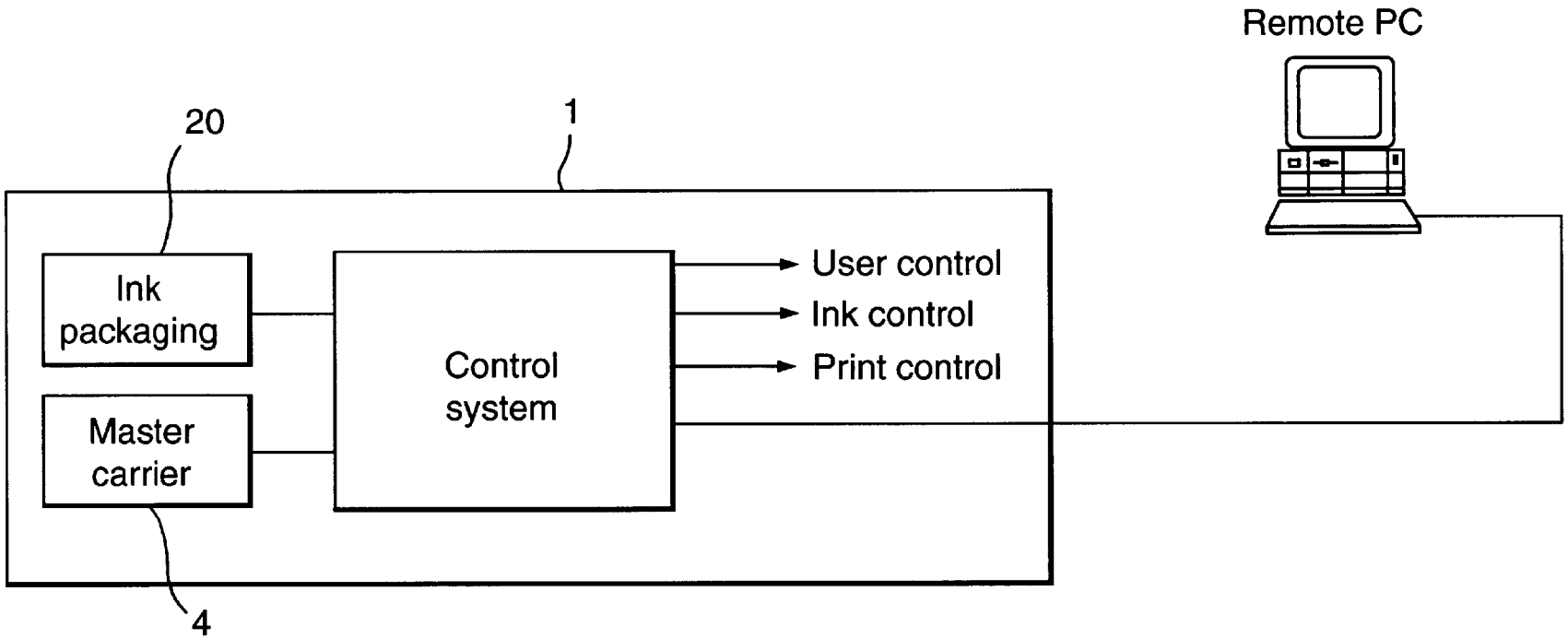
FIG. 3 is a schematic diagram of the duplicator system.

FIG. 3 shows a schematic overview of the duplicator apparatus according to the present invention. This shows a duplicator 1 having a control system which receives information from the smart chips on the consumable used in the duplicator. FIG. 3 shows connections to the ink packaging 20 and the stencil master carrier 4. The control system reads data therefrom and if the data is inappropriate, for example the ink cartridge is empty or the wrong type of master has been inserted, the control system switches the duplicator into a protected mode whereby an alarm such as a warning tone may be provided to the user via the user control, the ink pump may be prevented from working or alternatively the duplicator may be prevented from operating at all.

Figure 4:
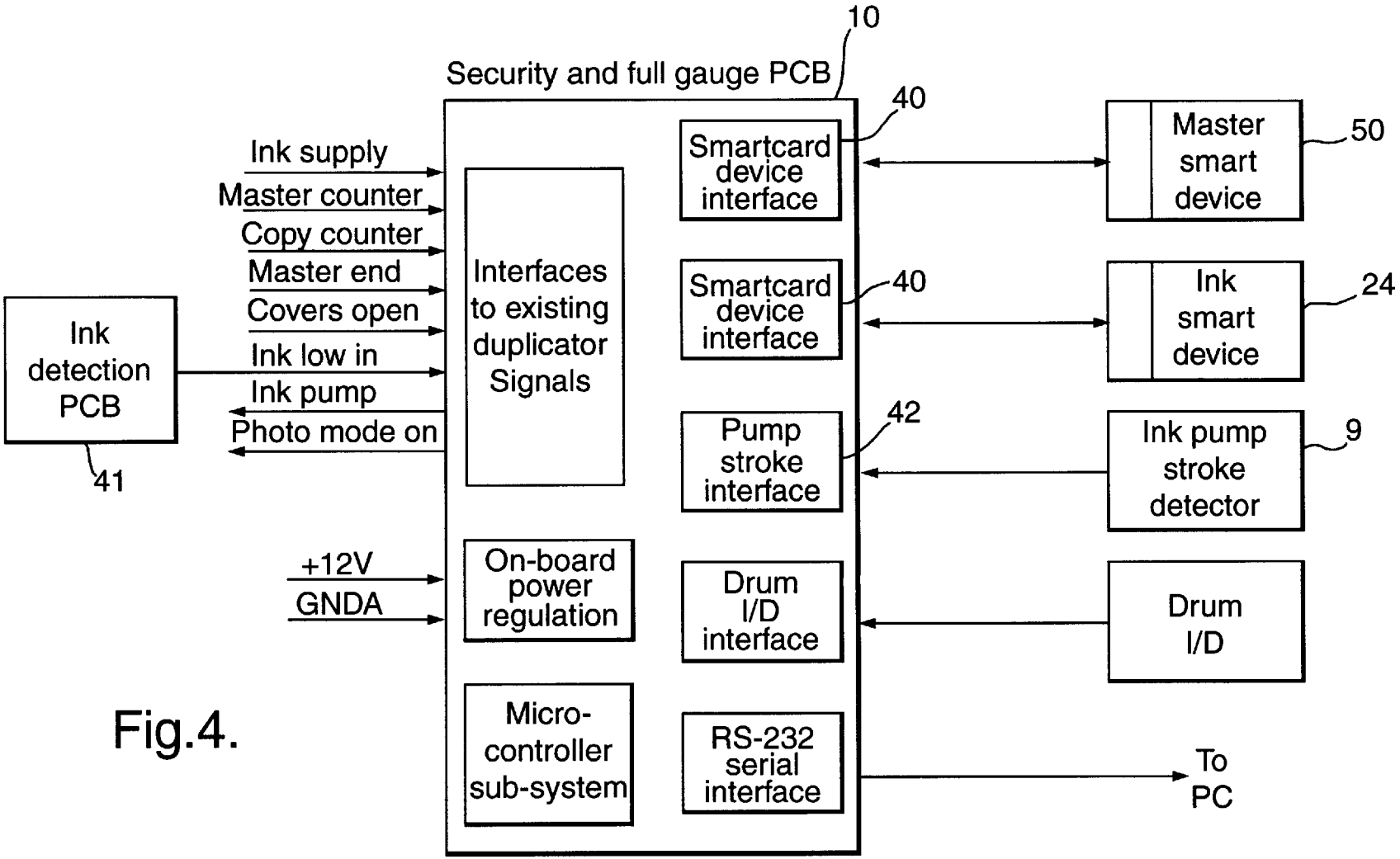
FIG. 4 shows a detailed schematic diagram of the control system for the present invention.

FIG. 4 shows a more detailed schematic diagram of the operational control system used in a duplicator according to the present invention. The control system includes interfaces 40 allowing data to be transferred between the control means and the smart chip on the ink packaging and stencil master roll. Whenever a new ink cartridge or stencil master roll is inserted into the duplicator, the data already stored in the smart chip is read into the control device via the interfaces 40. The data retrieved is then compared with the current system status to ensure that the ink or master is compatible and that the fuel gauge does not read zero, i.e. there is ink or master remaining.

The inking drum 5 is in this case provided with identification means to identify its type and the color of ink for which is to be used. This identification means may be in the form of a simple electrical contact pad or may also include a smart chip device. The controller 10 checks that the size and design of the drum corresponds to the stencil master that is inserted and also that the colour and type of ink is appropriate to the color and type allocated to the drum.

Once the controller has completed these checks of the consumable, then the user can start using the duplicator. During operation of the duplicator, ink in the drum is used up as it is passed through the porous outer wall onto the paper. Ink is pumped from the ink supply into the drum by an ink pump. The ink detection PCE 41 monitors the amount of ink in the drum using a level detector, connected via a connector 11, and when it falls below a predetermined level sends a signal to the control means. The control means then outputs a signal to the ink pump to initiate pumping. The ink pump which in this example is a reciprocating cylinder type, pumps ink from the ink container into the inking drum 5. Each cycle of the pump is monitored by an ink pump stroke detector 9 which provides signals which are again fed back to the control means by a interface 42. The control unit then decrements the counter in the smart chip 24 on the ink container.

The control means also monitors the operation of the duplicator to check if the ink pump is activated but no such pump action is being detected by the ink pump stroke detector 9. This may occur if the pump has failed or if the detector is jammed in one position. Under these circumstances, the duplicator switches to a protected mode as described below.

Similarly each time a new master is produced by the duplicator, the control means 10 decrements the counter in the master smart chip 50.

This provides a record of the amount of ink remaining in the container or master on the master reel even if the duplicator is turned off or the consumable in question is removed from the machine.

The control panel also provides additional protection in that if the duplicator detects that the end of a master roll is reached or that an ink detector in the drum continues to indicate a low ink state despite the ink pump being operated, then the respective counter in the master smart chip and in the ink container smart chip is set to zero indicative of the exhausted state.

Once one of the smart chips indicates that the consumable it relates to has reached the zero level, or if the smart chip provides inappropriate or no data (eg. blue ink instead of black ink, an A3 master instead of A4 master) then the control means switches the duplicator into operating in protected mode. In this protected mode, the duplicator may do one of a number of things:

It may be desirable to prevent operation of the duplicator at all.

Alternatively, the duplicator could be allowed to continue but with limited function. For example, if an incorrect ink cartridge is inserted, it may still be possible to operate the duplicator using the ink remaining in the drum. However, to prevent the newly inserted but incorrect ink being mixed with the residual ink remaining in the drum, the ink pump is inhibited. This will allow the duplicator to operate normally briefly until the residual ink in the drum is depleted. This allows the user to continue to operate the duplicator even though the correct ink cartridge may not be immediately available.

Duplicators of this kind often have a choice of duplication modes. For example a text mode may be provided for copying text and solid line images, and a photo mode may be provided for duplicating images which have half tone quality shading. In the photo mode pixels are dropped by the scanning means 2 to reduce the number of holes produced on the stencil master. This limits the amount of ink transferred to the paper and provides improved contrast for the reproduction of shaded images. The choice of these two modes is usually selected by the user but in the protected mode, it may be desirable to force the duplicator to work in photo mode. This will produce only masters of the photo quality. This has two effects: firstly the amount of ink used to produce a print is much less than in the text quality mode; and secondly, the quality of images is slightly poorer than when producing text.

Controller 10 is also provided with an interface which can be connected to an external PC or to a display incorporated on the user panel to provide a visual indication of the amount of consumable material remaining and also information about the status of the machine. For example the amount(s) of remaining consumable (ink, master) could be provided, the status of the consumable e.g. type, quality, size, and whether or not the consumable is appropriate for operation of the device i.e. whether or not the device will switch to protected mode in the event of an attempt to use those consumables.

Although this interface is connected to a PC, a single PC can be used to control a number of duplicating machines. This allows an operator to monitor the status of several machines simultaneously thus providing easier control of complex duplicating operations and allowing the user to be rapidly alerted to the occurrence of a problem with any of the machines such as the ink supply being exhausted.

This not only allows a plurality of different duplicating machines to be controlled by the single PC in order to enable that PC to display the remaining consumable (for example ink and stencil material) of the set of machines, but also facilitates management of the printing supplies in a print room.

For example, if the electronic memory means of the packaging of the consumable (the ink box or the stencil master roll) is also able to record an identification of the consumable in question (for example the serial number of a particular ink box or a particular stencil master roll) then as each newly acquired package of consumable material is booked into the plant it can be identified and its current status level (presumably full) can be recorded on the stock controlling computer. From then on whenever that particular consumable package is inserted or re-inserted in a duplicating machine the decrementing of the counter in the electronic means of that packaging will not only (i) result in the packaging next time giving rise to a correct "current status" value detected by the duplicator or other utilisation means involved, but will also (ii) be capable of being stored on the computerised control system so that not only those consumable packages which are currently in use, but also those which are in store, may be monitored. This is particularly advantageous in the case of stencil duplicators where a single ink colour is run at any one time on a particular duplicator and there will therefore naturally be spare ink containers on the premises ready for insertion when later that colour is to be printed. In a single print room the "alternative colour" ink cartridge may be stored centrally rather than alongside each particular duplicator (to ensure better stock consumption and rotation). Hence the controlling computer will have a record of not only the ink contents of the cartridge actually in each duplicator but also the contents of all spare ink containers, together with a record of the colour in question, so that an adequate but not excessive reserve of each particular colour can be maintained and can be monitored on the computer.

More ambitiously, it is possible to arrange for remote location of the or another PC so that the supplier of the ink, stencil material or other consumable can be able to update his records regarding the reserve of consumable materials at his customers' plants and can automatically re-supply in time to avoid total depletion of any particular type of consumable at a particular plant.

In this ideal situation the electronic memory means on the package will therefore record the following data:

(a) the type of consumable (e.g. ink or stencil material);

(b) the unique identity (serial number) of that package;

(c) the remaining count on the decrementing counter means of the electronic memory means; and (d) the particular nature of the consumable (the type of stencil material or the colour of ink).

In practice the unique identity serial number and the particular type of consumable material may be interrelated, so that the serial number of the unique identity of the ink container or stencil material roll will automatically indicate the particular type of ink (color) or stencil material in question.

Also, in the case of a stencil duplicator the ink screen or duplicator drum may have its own coding means so that exchange of one ink color to another without exchanging the ink screen or drum for one using the respective color will give rise to at least an alarm and preferably also a disable signal to prevent operation of the duplicator which would result in pollution of the inks.

Although this embodiment relates to a stencil duplicator, clearly this method of storing information on the packaging of a consumable can be utilised in any number of applications. It is therefore intended that this invention not be limited to stencil duplicators, but may be used in a wide range of other machine types. One such type in the electrostatic photocopier.

This system may also be fitted to an existing copy printer in the form of a retro-fit kit. The kit would include a control board to interface with the existing controller and to provide the new functions, a modified ink level detector PCB, modified holder mounting for the ink package, modifier receiving portion for holding the master reel, pump monitoring means, optional serial interface connection means and appropriate electrical interconnections. The kit may optionally include a modified drum including a drum identification means and an interface and detector for attachment to the duplicator for reading and interpreting the drum identification means and providing such data to the control PCB. The purpose of such identification has been explained above.

What is claimed is:

1. A processing apparatus and a consumable material which is utilized therein comprising:

a) a plurality of utilization means for using said consumable material said utilization means being a stencil duplicator having two or more reproduction quality modes;

b) a personal computer for controlling operation of said apparatus all of said utilization means being connected to said personal computer as a common control means;

c) a package for containing said consumable material;

d) holder means for said package, said holder means being provided with electrical contacts connected to corresponding contacts on said package;

e) an electronic memory means in said package connected to said package contacts for providing data indicative of the status of the consumable material;

f) said control means being operative to interrupt normal operation of said utilization means in the absence of expected status data; and, g) said electronic memory means including a counter to be decremented by the control means as the utilization means uses the consumable material wherein said control means switches the reproduction quality to a minimum level after said interruption of normal operation.

2. An apparatus according to claim 1 wherein the consumable material is a supply of stencil masters and wherein the utilization means includes a stencil master feed means.

3. A package for consumable material including the consumable material, and electronic memory means including a decrement only counter to be actuated for decrementing to a different value, said package including connection means for connecting said electronic memory means to an apparatus according to claim 1, for decrementing of the counter by apparatus.

* * * * *